US008836236B1

(12) United States Patent
Chiang et al.

(10) Patent No.: US 8,836,236 B1
(45) Date of Patent: Sep. 16, 2014

(54) LED OFFSET VOLTAGE DIMMER

(71) Applicants: Lee Chiang, Sylmar, CA (US); Tom O'Neil, Torrance, CA (US)

(72) Inventors: Lee Chiang, Sylmar, CA (US); Tom O'Neil, Torrance, CA (US)

( * ) Notice: Subject to any disclaimer, the term of this patent is extended or adjusted under 35 U.S.C. 154(b) by 28 days.

(21) Appl. No.: 13/886,522

(22) Filed: May 3, 2013

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |
| ***H05B 33/08*** | (2006.01) |

(52) U.S. Cl.
CPC ..... *H05B 33/0845* (2013.01)
USPC ..... 315/291; 315/257; 315/287; 315/299; 315/307

(58) Field of Classification Search
None
See application file for complete search history.

(56) References Cited

U.S. PATENT DOCUMENTS

2012/0153866 A1* 6/2012 Liu ..... 315/294
2013/0049589 A1* 2/2013 Simi ..... 315/85

* cited by examiner

*Primary Examiner* — Anh Tran
(74) *Attorney, Agent, or Firm* — Clement Cheng

(57) ABSTRACT

An LED driver has a power supply configured to receive power from a power input. A primary controller configured to receive power from the power supply and output power to a power output. The power output is configured to be connected to LED lights. A dimmer provides a dimming signal, and the dimmer has an adjustable voltage circuit. An offset voltage is added to a ground path on the adjustable voltage circuit. The offset voltage can be created by a silicon diode adding the offset voltage to a transformer's secondary winding ground path on a DC regulated voltage circuit. The adjustable voltage circuit can be formed as the DC regulated voltage circuit. The DC regulated voltage circuit is a 10 VDC regulated voltage circuit.

15 Claims, 2 Drawing Sheets

LED OFFSET VOLTAGE DIMMER

FIELD OF INVENTION

The present invention is in the field of LED light dimming technologies.

DISCUSSION OF RELATED ART

LED stands for light emitting diode. LED lighting is a different and relatively newer technology than incandescent and fluorescent lighting. An LED lighting system requires a power source that powers a driver. The driver controls the electrical power to the LED. The LED driver can also have a dimmer.

Traditional LED driver dimming has various difficulties in controlling current at a low voltage such as from 0-10 VDC. As an aside, AC voltage also has its problems since one problem that occurs on AC voltage is flickering which has been addressed in a variety of different patents such as U.S. Pat. No. 8,310,171. DC dimming also has difficulties to control current at small voltages. The minimum that LED current can go down to is about 6% or 7% before shutting off, and this is too bright for some applications.

SUMMARY OF THE INVENTION

An LED driver has a power supply configured to receive power from a power input. A primary controller configured to receive power from the power supply and output power to a power output. The power output is configured to be connected to LED lights. A dimmer provides a dimming signal, and the dimmer has an adjustable voltage circuit. An offset voltage is added to a ground path on the adjustable voltage circuit. The offset voltage can be created by a silicon diode adding the offset voltage to a transformer's secondary winding ground path on a DC regulated voltage circuit. The adjustable voltage circuit can be formed as the DC regulated voltage circuit. The DC regulated voltage circuit is a 10 VDC regulated voltage circuit.

A secondary feedback controller provides a feedback signal to the primary controller. The dimmer provides a dimming signal to the secondary feedback controller. An EMI filter provides for filtering DC power from the power supply. The LED driver has a power feedback circuit connected to a power feedback input of the primary controller allowing the primary controller to control power. The LED driver also has an overcurrent feedback monitor connected to an overcurrent feedback input of the primary controller allowing the primary controller to detect and control current. The LED driver also has an overvoltage feedback monitor connected to an overvoltage feedback input of the primary controller allowing the primary controller to prevent overvoltage. The LED driver preferably has the power feedback circuit connected to a power feedback input of the primary controller allowing the primary controller to control power; an overcurrent feedback monitor connected to an overcurrent feedback input of the primary controller allowing the primary controller to detect and control current; and an overvoltage feedback monitor connected to an overvoltage feedback input of the primary controller allowing the primary controller to prevent overvoltage. A QVSS discharge transistor is preferably connected between LED output wires +DC and −DC of the power output.

It is an object of the present invention to turn the LED current fully OFF at 0 VDC Dimming signal voltage while still maintaining semiconductor functioning at minimum semiconductor functioning voltage such as 0.6 VDC and above to achieve a full off state of the lamp. It is also an object of the present invention to add a 0.6 VDC or other preset "offset voltage" to transfer the original 0 VDC "as if" it is the semiconductor's minimum operation voltage, which can be 0.6 VDC. A preferred means of achieving the objects of the invention is to use a regular silicon diode forward conduction 0.6 VC voltage as the offset voltage to implement the LED full off function. This silicon diode can be added on the transformer's secondary winding ground path on a 10 VDC regulated voltage circuitry (for other internal use). The 0-10 VDC dimming signal can then be referenced to the cathode of the silicon diode, which is now −0.6 VDC with respect to the original dimming circuitry. This allows the LED current to be fully turned off or very close to being turned off, such as having a 0.2 VDC or 0.3 VDC input signal.

Figure 1:
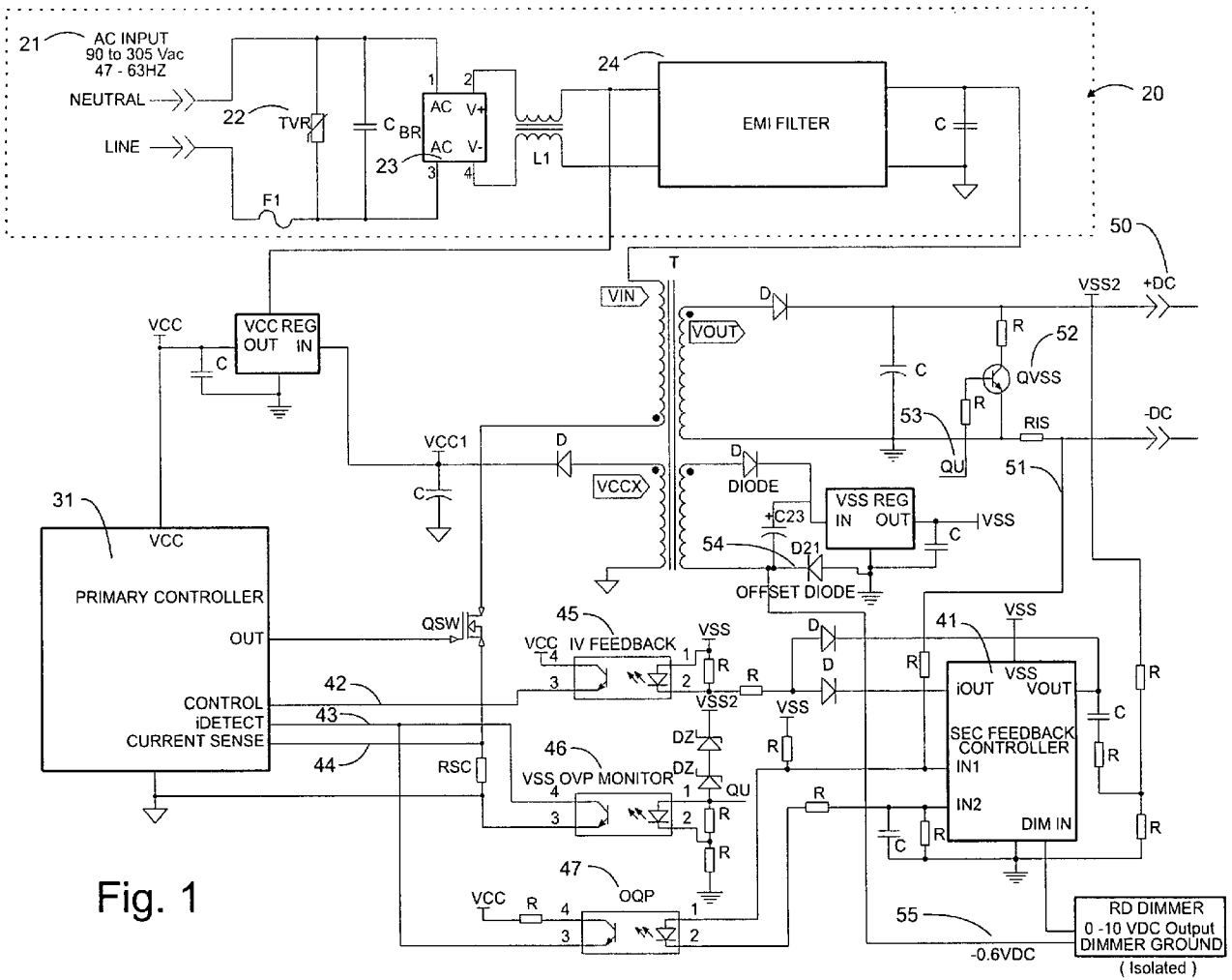
FIG. 1 is a circuit and block diagram showing offset voltage being provided by a diode.

The following callout list of elements can be a useful guide to reference the element numbers of the drawings.

20 Power Supply
21 AC Input
22 Transient Voltage Suppressor
23 Bridge Rectifier
24 EMI Filter
31 Primary Controller
41 Secondary Feedback Controller
42 Control Signal
43 Detection Signal
44 Current Sensing Signal
45 IV Feedback Monitor
46 Over Voltage Protection Monitor
47 Over Current Feedback Monitor
50 Output Voltage
51 OQP Feedback Wire
52 Discharge Transistor
53 OVP Monitor Input Wire
54 Offset Diode
55 Offset Voltage
56 Offset Battery
57 RD Dimmer

DETAILED DESCRIPTION OF THE PREFERRED EMBODIMENT

The present invention is an electrical circuit that provides dimming control for light emitting diode (LED) lamps. The electrical circuit is commonly printed on a printed circuit board (PCB) and may have one or more integrated circuits (IC) chips soldered to the PCB. A variety of common electrical engineering concepts and terms are used for describing the circuit and these will be defined herein. VCC is an abbreviation for common collector voltage and VSS is an abbreviation for voltage common source. In an electrical diagram, the portions of the diagram denoted as VCC are at the same voltage. VCC is a standard abbreviation for common collector voltage which is typically a common voltage for IC input voltage source. VCCX is a different voltage level than VCC because sometimes the circuit requires multiple VCC, and we therefore VCC1, VCC2 and VCCX denotes other VCCs at different voltages.

There are a variety of sub circuits on the circuit diagram. Generally, a power supply 20 is plugged into the wall. The power supply can be in a separate housing or can be in the same housing as the remainder of the circuit. Generally, the circuit can be plugged into household electric current at an AC input 21 which can be a two prong plug commonly plugged into a wall socket at 120 VAC in the United States and 240 VAC in China. AC input 21 can be modified by a TVR which is an abbreviation of transient voltage suppressor 22. The transient voltage suppressor 22 is a semiconductor device that will begin to conduct current when voltage is over a specified value. TVR limits the surge voltage on the AC power source to protect the LED driver. The bridge rectifier 24 can be abbreviated as BR. The bridge rectifier has four rectifiers to form a bridge with two input pins for the AC power source and two output pins to provide a full wave rectification to DC voltage power supply.

After the alternating current (AC) power is converted to direct current (DC) power, the DC power goes to an EMI filter which is a group of chokes, capacitors and inductors to filter out unwanted electromagnetic interference (EMI) noise. EMI stands for electromagnetic interference. The electromagnetic interference filter is made according to specifications stated by law such as FCC Federal Communications Commission Section 47 Pat 15 Class A and Class B. The AC to DC transformer converts the primary side AC power source to a secondary side DC power source that is rectified to drive the LED. The letters REG stand for Regulator on the DC side of the circuit. Usually an IC chip input voltage has too much variation and the output voltage is "regulated" to a fixed clean DC voltage. The Transformer lower-right coil output AC voltage is "half-wave" rectified by a diode and filtered by a capacitor. This voltage has a lot of ripples so it goes through a Voltage Regulator "REG" to ouput very clean +10 volts or +12 volts DC voltage to power up the circuits on the secondary side.

The present invention has a primary controller 31 and a secondary feedback controller 41. The primary controller 31 is an integrated circuit chip abbreviated as IC chip. The primary controller receives a control signal 42, a detection signal 43 and a current sensing signal 44. The control signal is received by the IV feedback circuit which is the current and voltage feedback. An Opto-Coupler IC checks the LED output current (I) and voltage (V), which is controlled by the secondary feedback controller IC 41, which checks the LED current and voltage. IV stands for current and voltage where the I stands for the current and the V stands for the voltage. The two signals current "iOUT" and voltage "VOUT" are combined by 2 Diodes and feed into the Opto-Coupler. The signal is also isolated by the Opto-Coupler and feedback to the primary controller control input pin 42.

The primary controller 31 also receives a signal from an OVP Monitor 46 which is the over voltage protection monitor. OVP stands for over voltage protection. An Opto-Coupler IC checks the LED output voltage VSS2 with couple of Zener Diodes DZ. If VSS2 is too high, then the Opto-Coupler transmits (isolated signal) the signal from the secondary low-voltage direct current side to the primary alternating current high voltage side. This allows primary controller to lower the output voltage 50.

The over current feedback monitor 47 is abbreviated as OQP feedback for over current feedback. OQP stands for Over Current Protection. The LED lamp is loaded on the output port "+DC" and "−DC" which supplies the output voltage 50. The LED current flows through Resistor RIS which stands for a current sense resistor. In RIS, the R stands for resistor, the I stands for current, and the S stands for sense. The RIS is before the Secondary Side ground. The LED current passes through RIS to produce a small voltage that is picked up at the OQP feedback wire 51 and an isolated signal is fed to the OQP Opto-Coupler and then sent to the primary controller "iDETECT" pin to lower the output current if the output current 50 is over the designed allowable maximum current. RSC stands for resistor sensing current. The resistor that facilitates current sensing is connected to the current sense input pin of the primary controller.

The output of the primary controller is power that is controlled by the QSW. The QSW is an electronically controlled power switch. QSW refers to an industrial standard to use the letter Q to denote Transistors or MOSFETs (Metal Oxide Semiconductor Field Effect Transistor). Q1, Q2, Q3 would denote Transistor/MOSFET number 1, number 2 and number 3. The SW denotes switching. QSW therefore refers to a switching transistor or MOSFET. This LED Driver is essentially a Switching Mode Power Supply (SMPS), so that the Transistor/MOSFET main job is to 'switch" on and off of the input voltage. The MOSFET is more efficient at switching than a traditional transistor. In SMPS design, usually MOSFET are used.

The QVSS is the discharge transistor 52 connected between the LED output 2 wires +DC and −DC. The QVSS is normally turned OFF by the signal named "QU" (at OVP Monitor Opto-Coupler pin-1). When the AC power source is turned OFF, the LED Driver will stop running. However, the large filtering capacitor "C" (at the left of Transistor QVSS) still holds output voltage and electrical charge inside. Immediately after the AC power is turned OFF, the QU signal will begin to turn ON Transistor QVSS, which will quickly discharge the capacitor C. The LED light will be quickly turned OFF after the AC power source is turned OFF. Without the QVSS, the LED will continuously output light at lower intensity for a long time, and this afterglow is not desired by the user. The QVSS is a discharge device to turn OFF the LED quickly after the AC power is turned off. The Q in QVSS refers to a transistor. Since VSS is the symbol for the LED output voltage (+DC is also assigned as VSS2) and this transistor is connected to the VSS2, the transistor is named QVSS. The VSS2 transistor is therefore called the QVSS which is the discharge transistor 52.

QU is a net name for a wire. A net name is a wire that is assigned a name. Instead of drawing a long connecting wire on the schematic leading to clutter, the wire is omitted. The long wire is replaced with "QU" at 2 places. The actual circuitry of these 2 nets named "QU" is connected. The first "QU" is next to the QVSS (after going through a Resistor on the Base Electrode), and it is connected to the $2^{nd}$ "QU" on pin-1 of the $2^{nd}$ Opto-Coupler "OVP MONITOR". The QU wire is the OVP Monitor input wire 53.

Some silicon semiconductors will not work at low voltage less than 0.6 VDC. The original 0-10 VDC dim signal can not further reduce LED current when it is below 0.6 VDC since the controller itself shuts off. The LED current will remain at about 5% which may be too bright for some low light conditions such as walk way accent, theater or night lights. Traditionally, if a dimming circuit is 0-10 VDC, voltage applied to the dimming circuitry is limited to 0 to 10 VDC.

The present invention solves the technical issue by applying a voltage level shift called an offset voltage. For example, a 0.6 VDC level shift can be applied to the original minimum silicon operation so that 0.6 VDC becomes 1.2 VDC, and the original OVDC is shifted up to the minimum silicon working limit of 0.6 VDC. The implementation of 0.6 VDC offset is not likely to be regulated by any voltage regulator, due to the low voltage 0.6 VDC limit.

Figure 2:
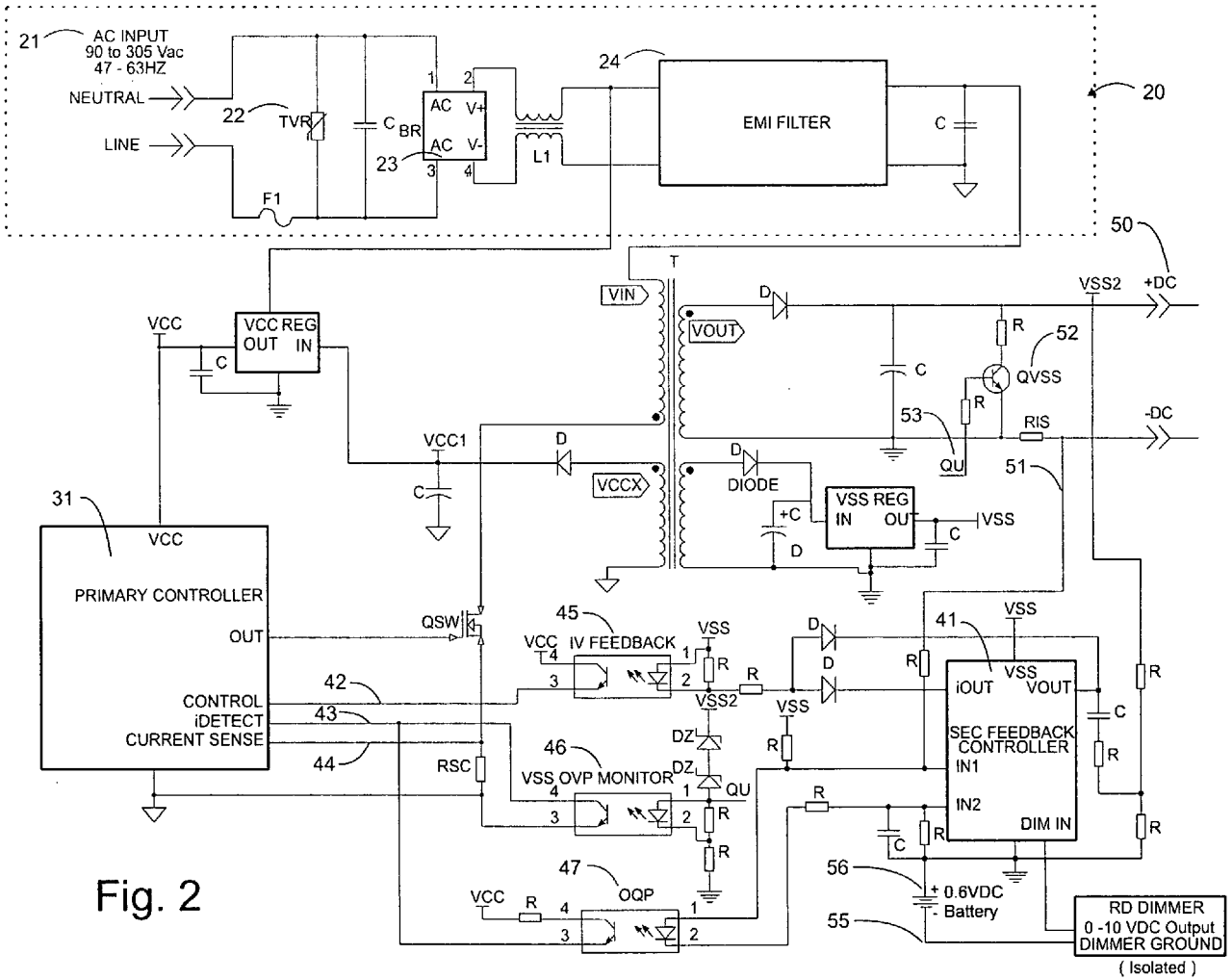
FIG. 2 is a circuit and block diagram showing offset voltage being provided by a battery.

One means to generate an offset voltage of a value such as 0.6 VDC, as seen in FIG. 1, is to use a silicon diode having a forward conduction voltage of 0.6 VDC. A proposed diode such as D21 can be the offset diode 54 which is inserted between the transformer secondary winding's ground and the filtering capacitor C23. The cathode of C23 is a −0.6 VDC (negative 0.6 VDC) voltage source. A second means to generate an offset voltage 55 that could have a value of 0.6 VDC, as seen in FIG. 2, is to replace the silicon diode with an offset battery 56 that generates 0.6 VDC. The term 'battery' herein refers to battery equivalents as well as actual batteries such as a button battery that fits into a plastic housing and needs to be changed out every two years using a human fingers or tweezer tools.

The RD dimmer 57 has an output voltage terminal typically from 0-10 VDC and has also a ground terminal. RD stands for rotary dial, but any type of dimmer can be used. The RD dimmer 57 has 0-10 VDC dimming wires that can be made in different colors. For example, purple can be used for positive 0 to 10 VDC, and gray can be used for reference tied to secondary ground. In this case, the dimmer gray wire usually used for ground should be connected to the −0.6 VDC offset voltage 55, rather than the ground. When the 0-10 VDC dimming signal is grounded, the dim voltage is 0 VDC but it is actually negative zero point six volts direct current (−0.6 VDC) from the point of view of the LED Driver. Thus, the LED Driver will turn the LED current lower and all the way to 0 at −0.6 VDC. Note that the dimming signal should be isolated to the LED driver.

By means of the offset voltage 55, the LED is fully turned off at 0.3V, which will accommodate all applications assuming that hardwired or mechanical relays can reach 0.0V, and transistors/MOSFET IC's semiconductor can reach 0.2 to 0.25 VDC. It is preferred that the 0-10 VDC sink current is reduced to 1.84 mA for 120 VAC@60 Hz, or 1.90 mA for 230 VAC@50 Hz. The values for the resistors and other components are sized according to the design parameters of the desired device. Such values can be determined by standard circuit analysis that can be performed on computer programs or by hand calculations.

The invention claimed is:

1. An LED driver comprising:

a. a power supply configured to receive power from a power input;

b. a primary controller configured to receive power from the power supply and output power to a power output;

c. a dimmer providing a dimming signal;

d. a an offset voltage added to a ground path on an adjustable voltage circuit.

2. The LED driver of claim 1, wherein the offset voltage is created by a silicon diode adding the offset voltage to a transformer's secondary winding ground path on a DC regulated voltage circuit, wherein the adjustable voltage circuit is formed as the DC regulated voltage circuit.

3. The LED driver of claim 2, wherein the DC regulated voltage circuit is a 10 VDC regulated voltage circuit.

4. The LED driver of claim 2, further comprising:

a. a secondary feedback controller providing a feedback signal to the primary controller; wherein the dimmer provides a dimming signal to the secondary feedback controller.

5. The LED driver of claim 1, further comprising:

a. an EMI filter for filtering DC power from the power supply.

6. The LED driver of claim 1, further comprising:

a. a secondary feedback controller providing a feedback signal to the primary controller; wherein the dimmer provides a dimming signal to the secondary feedback controller.

7. The LED driver of claim 1, wherein the offset voltage is created by a battery adding the offset voltage to a ground path on a 10 VDC regulated voltage circuit.

8. The LED driver of claim 1, further comprising:

a. an EMI filter for filtering DC power from the power supply.

9. An LED driver comprising:

a. a power supply configured to receive power from a power input;

b. a primary controller configured to receive power from the power supply and output power to a power output, wherein the power output is configured to be connected to LED lights;

c. a dimmer providing a dimming signal, wherein the dimmer has an adjustable voltage circuit;

d. a an offset voltage added to a ground path on the adjustable voltage circuit, wherein the offset voltage is created by a silicon diode adding the offset voltage to a transformer's secondary winding ground path on a DC regulated voltage circuit, wherein the adjustable voltage circuit is formed as the DC regulated voltage circuit, wherein the DC regulated voltage circuit is a 10 VDC regulated voltage circuit;

e. a secondary feedback controller providing a feedback signal to the primary controller; wherein the dimmer provides a dimming signal to the secondary feedback controller; and f. an EMI filter for filtering DC power from the power supply.

10. The LED driver of claim 9, further comprising: a power feedback circuit connected to a power feedback input of the primary controller allowing the primary controller to control power.

11. The LED driver of claim 9, further comprising: an overcurrent feedback monitor connected to an overcurrent feedback input of the primary controller allowing the primary controller to detect and control current.

12. The LED driver of claim 9, further comprising: an overvoltage feedback monitor connected to an overvoltage feedback input of the primary controller allowing the primary controller to prevent overvoltage.

13. The LED driver of claim 9, further comprising: a power feedback circuit connected to a power feedback input of the primary controller allowing the primary controller to control power; an overcurrent feedback monitor connected to an overcurrent feedback input of the primary controller allowing the primary controller to detect and control current; and an overvoltage feedback monitor connected to an overvoltage feedback input of the primary controller allowing the primary controller to prevent overvoltage.

14. The LED driver of claim 13, further comprising: a QVSS discharge transistor connected between LED output wires +DC and −DC of the power output.

15. The LED driver of claim 9, further comprising: a QVSS discharge transistor connected between LED output wires +DC and −DC of the power output.

* * * * *